US010676828B2

(12) United States Patent
Dadvand et al.

(10) Patent No.: US 10,676,828 B2
(45) Date of Patent: Jun. 9, 2020

(54) CONVERSION COATING AND METHOD OF MAKING

(71) Applicant: SAINT-GOBAIN PERFORMANCE PLASTICS CORPORATION, Solon, OH (US)

(72) Inventors: Nazila Dadvand, Worcester, MA (US); Nafih Mekhilef, Shrewsbury, MA (US); Yi Jiang, Shrewsbury, MA (US); Raymond J. White, Agawam, MA (US)

(73) Assignee: SAINT-GOBAIN PERFORMANCE PLASTICS CORPORATION, Solon, OH (US)

( * ) Notice: Subject to any disclaimer, the term of this patent is extended or adjusted under 35 U.S.C. 154(b) by 140 days.

(21) Appl. No.: 15/694,106

(22) Filed: Sep. 1, 2017

(65) Prior Publication Data

US 2018/0057946 A1 Mar. 1, 2018

Related U.S. Application Data

(60) Provisional application No. 62/382,453, filed on Sep. 1, 2016.

(51) Int. Cl.
*C23C 22/05* (2006.01)
*C23C 22/62* (2006.01)
(Continued)

(52) U.S. Cl.
CPC ..... *C23C 22/05* (2013.01); *C23C 22/34* (2013.01); *C23C 22/361* (2013.01); *C23C 22/44* (2013.01); *C23C 22/48* (2013.01); *C23C 22/50* (2013.01); *C23C 22/53* (2013.01); *C23C 22/56* (2013.01); *C23C 22/60* (2013.01); *C23C 22/62* (2013.01); *C23C 22/66* (2013.01); *C23C 22/68* (2013.01);
(Continued)

(58) Field of Classification Search
CPC ..... C23C 22/80; C23C 22/361; C23C 22/44; C23C 22/56; C23C 22/66; C23C 22/72; C23C 22/74
USPC ..... 428/195.1
See application file for complete search history.

(56) References Cited

U.S. PATENT DOCUMENTS 5,026,440 A 6/1991 Finnenthal et al.
5,116,790 A 5/1992 Bruno et al.
(Continued)

FOREIGN PATENT DOCUMENTS

JP 2000204485 A 7/2000
KR 20140138999 A 12/2014

OTHER PUBLICATIONS

Metal Supermarkets, Galvanized Steel (Year: 2019).*
International Search Report/Written Opinion for PCT/US2017/049890, dated Nov. 16, 2017, 13 pages.

*Primary Examiner* — Betelhem Shewareged
(74) *Attorney, Agent, or Firm* — Abel Schillinger, LLP; Chi Suk Kim

(57) ABSTRACT

A composite can include a substrate and a conversion coating overlying the substrate and comprising at least one of a zirconium oxide, a hafnium oxide, or a combination thereof. The conversion coating can be formed from a zirconia or hafnia-based complex obtained by reacting at least one of a zirconium ion source, a hafnium ion source, or a combination thereof, with a chelating compound in a reaction and another chelating compound in another reaction.

20 Claims, 6 Drawing Sheets

(51) Int. Cl.

| | |
|---|---|
| ***C23C 22/53*** | (2006.01) |
| ***C23C 22/34*** | (2006.01) |
| ***C23C 22/68*** | (2006.01) |
| ***C23C 22/60*** | (2006.01) |
| ***C23C 22/48*** | (2006.01) |
| ***C23C 22/50*** | (2006.01) |
| ***C23C 22/72*** | (2006.01) |
| ***C23C 22/36*** | (2006.01) |
| ***C23C 22/66*** | (2006.01) |
| ***C23C 22/56*** | (2006.01) |
| ***C23C 22/44*** | (2006.01) |
| ***C23C 22/74*** | (2006.01) |
| ***C23C 22/80*** | (2006.01) |

(52) U.S. Cl.
CPC ..... *C23C 22/72* (2013.01); *C23C 22/74* (2013.01); *C23C 22/80* (2013.01)

(56) References Cited

U.S. PATENT DOCUMENTS

| | | | | |
|---|---|---|---|---|
| 8,993,119 | B2 | 3/2015 | Koch et al. | |
| 2002/0108678 | A1* | 8/2002 | Montano | C23C 22/52 148/276 |
| 2008/0041498 | A1* | 2/2008 | Inbe | C23C 22/80 148/254 |
| 2010/0285947 | A1 | 11/2010 | Weir et al. | |
| 2011/0094630 | A1 | 4/2011 | Yoshida et al. | |
| 2012/0088122 | A1 | 4/2012 | Matsuda et al. | |
| 2012/0145282 | A1 | 6/2012 | Kodama et al. | |
| 2012/0208043 | A1 | 8/2012 | Matsuda et al. | |
| 2014/0227514 | A1 | 8/2014 | Siebert et al. | |
| 2015/0056390 | A1 | 2/2015 | Miyai et al. | |
| 2016/0153093 | A1 | 6/2016 | Vonk et al. | |

* cited by examiner

CONVERSION COATING AND METHOD OF MAKING

CROSS-REFERENCE TO RELATED APPLICATION(S)

This application claims priority under 35 U.S.C. § 119(e) to U.S. Patent Application No. 62/382,453 entitled "CONVERSION COATING AND METHOD OF MAKING," by Nazila Dadvand et al., filed Sep. 1, 2016, which is assigned to the current assignee hereof and incorporated herein by reference in its entirety.

FIELD OF THE DISCLOSURE

The present disclosure relates to conversion coatings and more particularly to conversion coatings including at least one of zirconium oxide and hafnium oxide.

RELATED ART

Conversion coatings for metal surfaces can be used for a variety of applications, such as corrosion protection, decorative color, and paint primer. Existing conversion coatings can include materials that are detrimental to human health and to the environment. There exists a need for new materials for conversion coatings

BRIEF DESCRIPTION OF THE DRAWINGS

Embodiments are illustrated by way of example and are not limited in the accompanying figures.

Figure 1:
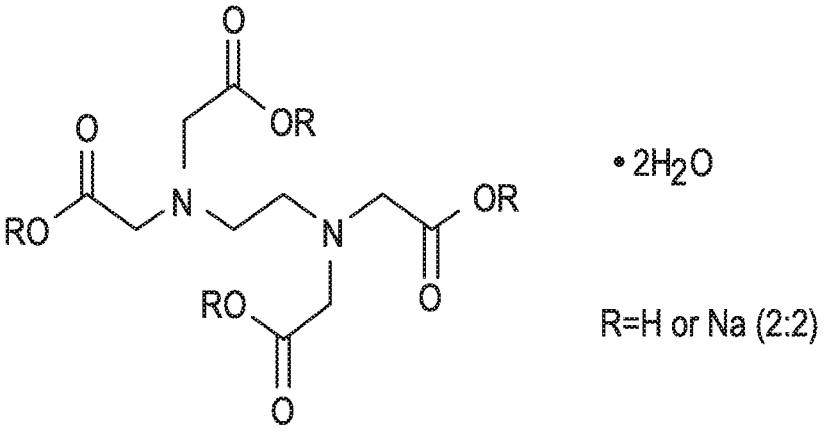
FIG. 1 includes an illustration of a chelating compound according to another embodiment described herein.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the conversion coating arts.

Described herein is a composition that can exhibit corrosion resistance, adhesion to paint, or both. In an embodiment, the composition can exhibit sufficient performance to replace chromium-based conversion coatings, such as $Cr^{VI}$ conversion coatings. For example, the composition can include a salt of at least one of zirconium and hafnium, and a mixture of appropriate chelating agents used in subsequent reactions to reduce formation of at least one of zirconium and hafnium oxyhydrate in solution. Applicants have discovered that adhesion and corrosion resistance can be improved by forming a zirconia or hafnia-based complex using a chelating compound in a reaction and another chelating compound in another reaction. The concepts are better understood in view of the embodiments described below that illustrate and do not limit the scope of the present invention.

In an embodiment, the composition can include a zirconia or hafnia-based complex. The zirconia or hafnia-based complex can be made by reacting a zirconium ion source, a hafnium ion source, or a combination thereof, with a first chelating compound in a first reaction and a second chelating compound in a subsequent second reaction. In a particular embodiment, the zirconium ion source can include a zirconium salt such as a zirconium(IV) fluoride hydrate, a zirconium oxynitrate, or combinations thereof.

Figure 2:
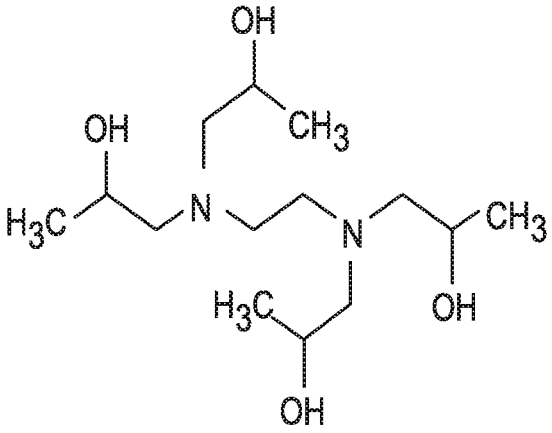
FIG. 2 includes an illustration of a chelating compound according to yet another embodiment described herein.

At least one of the first chelating compound and the second chelating compound can include an oxyanion. The oxyanion can include, for example, an organic amine or amide. In an embodiment, at least one of the first chelating compound and the second chelating compound can include an ethylene diamine, an aminopolycarboxylic acid, or a polyhydroxyalkyl alkylene polyamine. In a particular embodiment, the aminopolycarboxylic acid can include an ethylenediaminetetraacetic acid ("EDTA"). An example of an EDTA is illustrated in FIG. 1. In a particular embodiment, the polyhydroxyalkyl alkylene polyamine can include a N,N,N',N'-tetrakis(2-hydroxypropyl)ethylene diamine. An example of a N,N,N',N'-tetrakis(2-hydroxypropyl)ethylene diamine is illustrated in FIG. 2. Further examples of chelating compounds include a glycinate, an aspartic acid, an aminopolycarboxylate nicotianamine, an amino acid glycine, a 1,2-bis(o-aminophenoxy)ethane-N,N,N',N'-tetraacetic acid (BAPTA), a 1,4,7,10-tetraazacyclododecane-1,4,7,10-tetraacetic acid (DOTA), an ethylene glycol-bis(β-aminoethyl ether)-N,N,N',N'-tetraacetic acid (EGTA), a nitrilotriacetic acid (NTA), an iminodiacetic acid (IDA), and a diethylenetriaminepentaacetic acid (DTPA). In a particular embodiment, the first chelating compound can include an ethylene diamine, an aminopolycarboxylic acid, or a polyhydroxyalkyl alkylene polyamine, and the second chelating compound can include an ethylene diamine, an aminopolycarboxylic acid, or a polyhydroxyalkyl alkylene polyamine, so long as the first chelating compound and the second chelating compound are different.

Figure 3:
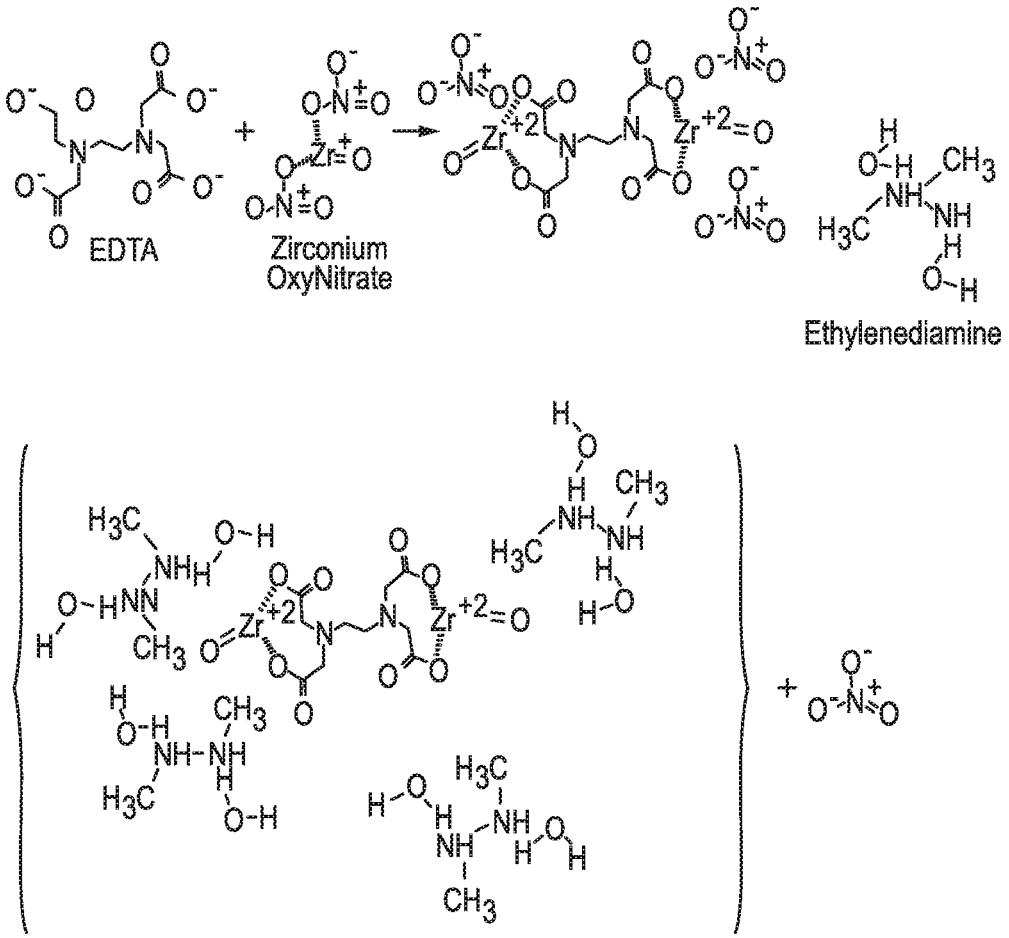
FIGS. 3 and 4 include an illustration demonstrating the mechanism of forming a zirconia-based conversion coating according to an embodiment described herein.
Figure 4:
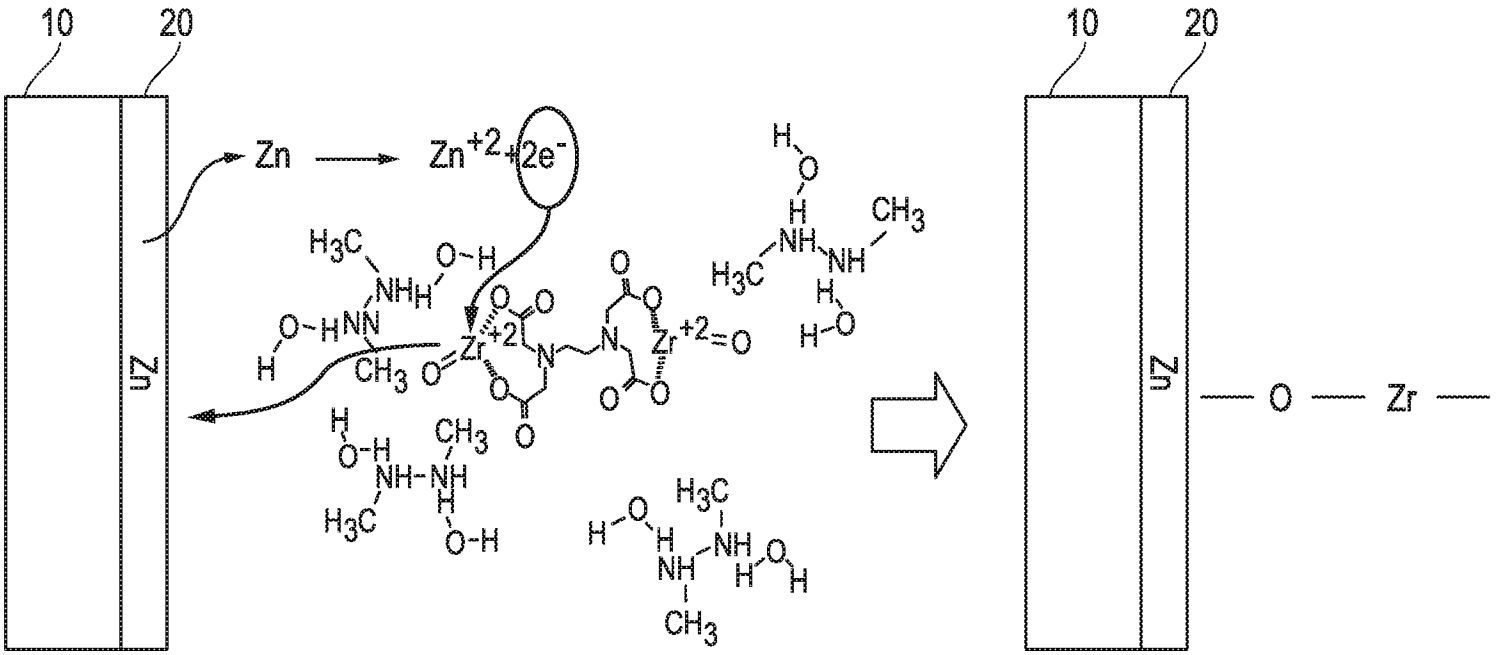

As mentioned previously, a combination of two or more of the chelating compounds described above can be reacted with a zirconium ion, a hafnium ion, a combination thereof, or a salt thereof, to form a complex. The complex can improve stability of the ion and reduce precipitation of a zirconium or hafnium containing compound in solution. FIGS. 3 and 4 include an illustration of a non-limiting example of the formation of a conversion coating using an embodiment of the composition described herein. In particular, FIG. 3 demonstrates the formation of the zirconia-based complex according to an embodiment described herein, and FIG. 4 demonstrates a migration of a zirconia-based complex towards the surface of a substrate 10 having a zinc coating 20, according to an embodiment described herein. As illustrated, the zinc coating 20 is exposed to the zirconia-based complex and engages in an exchange reaction with the zinc coating 20 to form a zirconia coating overlying the substrate. In the particular example illustrated in FIGS. 3 and 4, a zirconium oxynitrate first forms a complex compound with EDTA anions. The zirconium oxynitrate-EDTA complex is then reacted with an ethylene diamine to form an embodiment of the zirconia-based complex.

In an embodiment, the composition can include a corrosion resistance additive. The corrosion resistance additive can include a molybdate ion, a tungstate ion, or a combination thereof. For example, the composition can include at least one of a molybdate salt and a tungstate salt. In an embodiment, the complex described herein can be in solution. In a particular embodiment, the solution is an aqueous solution. For example, the solution can be free of an organic solvent.

In an embodiment, the zirconia or hafnia-based complex can be in a solution having a pH of at least 1, or at least 2, or at least 3, or at least 3.5, or at least 3.7, or at least 3.9, or at least 4. The solution can have a pH of at most 11, or at most 10, or at most 9, or at most 8.5, or at most 8.3, or at most 8.1, or at most 8.0. The solution can have a pH in a range of 1 to 11, or 2 to 10, or 3 to 9, or 3.5 to 8.5, or 3.7 to 8.3, or 3.9 to 8.1, or 4 to 8. For example, the pH of the solution can be in a range of 1 to 11, such as in a range of 2 to 8, such as in a range of 3 to 6, or even 3 to 5. In a particular embodiment, the pH of the solution can be in a range of 5 to 11, or 6 to 11, or 7 to 11, or 8 to 11, or 9 to 11. In an embodiment, the composition can include a pH adjustment additive. In an embodiment, the pH adjustment additive can include a mineral acid.

As mentioned previous, the composition can be a conversion coating. In an embodiment, the conversion coating can create a passive layer on a substrate surface. The passive layer can protect the substrate from corrosive environment, improve adhesion of paint to the substrate, or both.

In an embodiment, the substrate can include a metal surface. The metal surface can include a steel-based metal, an aluminum, a zinc, or oxides thereof. In a particular embodiment, the metal surface can include a zinc. Zinc can demonstrate poor corrosion resistance and adhesion. For example, zinc surfaces can be reactive and certain resins or paints can saponify when coated on zinc, causing the resin to eventually lose adhesion. An advantage of the composition described herein includes its use as a conversion coating that can exhibit improved corrosion resistance, improved adhesion between paint and the metal surface, or a combination of improved corrosion resistance and adhesion.

The substrate can include a metal backing underlying the metal surface. In an embodiment, the metal backing can include a metal different than the metal surface. For example, the metal backing can include at least one of aluminum, iron, an alloy thereof, or a combination thereof. In a particular embodiment, the metal backing can include an iron-based alloy, such as steel or even galvanized steel.

Also described herein is a composite comprising the conversion coating discussed above. In a particular embodiment, the composite can include a substrate and the conversion coating overlying the substrate. The substrate can include the substrate as described above. In particular, the composite can include an interlayer disposed between the conversion coating and the substrate. The interlayer can be the metal surface discussed above, such as a metal surface including alumina, zinc, or a combination thereof. Further, the conversion coating can be formed from the composition discussed above and can include at least one of zirconia and hafnia, or a combination thereof. In a particular embodiment, the conversion coating can be formed from a zirconia or hafnia-based complex obtained by reacting at least one of a zirconium ion source, a hafnium ion source, or a combination thereof, with a chelating compound in a reaction and another chelating compound in another reaction, as discussed above.

Also described herein is a method of preparing a zirconia or hafnia-based complex by reacting at least one of a zirconium ion source, a hafnium ion source, or a combination thereof, with a chelating compound in a reaction and a chelating compound in a subsequent reaction. A substrate can be exposed to the zirconia or hafnia-based complex to form a conversion coating overlying the substrate and comprising at least one of a zirconium oxide, a hafnium oxide, or a combination thereof.

Figure 5:
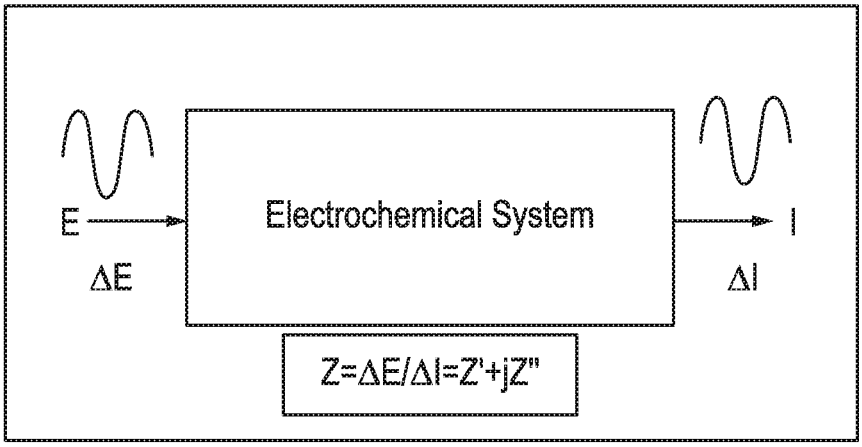
FIG. 5 includes an illustration of the electrochemical system used to measure corrosion resistance according to the Corrosion Resistance Test described herein.
Figure 6:
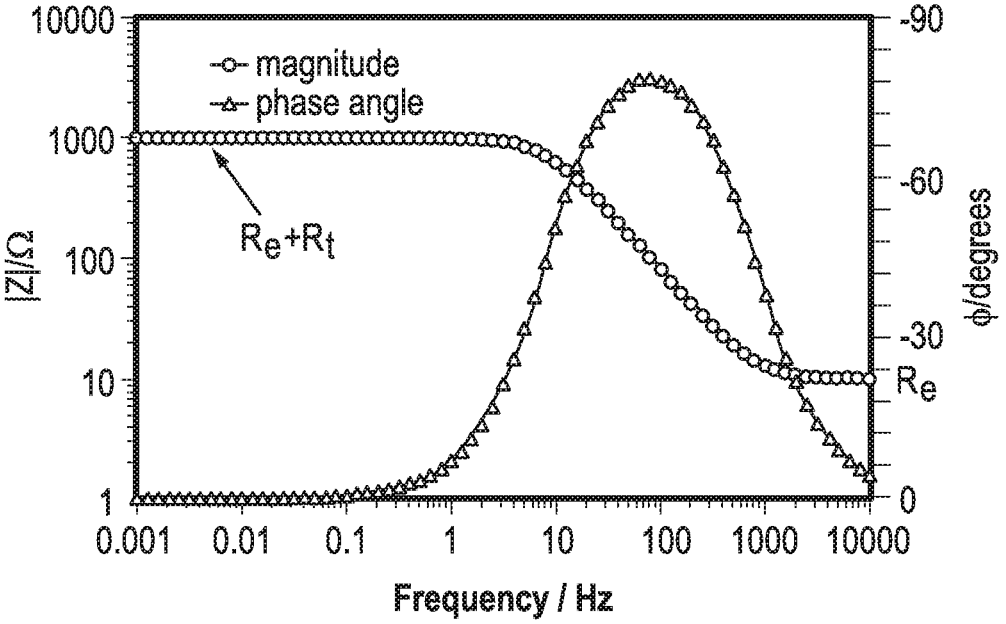
FIG. 6 includes an exemplary graph plotting impedance and corrosion resistance $R_t$ according to the Corrosion Resistance Test described herein.

In an embodiment, the conversion coating can exhibit improved corrosion resistance properties as measured according to the Corrosion Resistance Test. As described herein, the Corrosion Resistance Test measures corrosion resistance using impedance spectroscopy. The test procedure includes providing an electrochemical cell and adding a corrosive medium (3.5 wt % NaCl solution having a pH of 6.5) to the cell. Three electrodes are connected to the cell including a working electrode including the sample to be tested, a counter electrode including graphite, and a reference electrode including a saturated calomel electrode. The working electrode is exposed to the corrosive medium and a sinusoidal signal is applied to the cell. The resulting impedance is plotted and used to determine the corrosion resistance $R_t$. FIG. 5 includes an illustration of the electrochemical system used to measure corrosion resistance and FIG. 6 includes an exemplary graph plotting impedance and corrosion resistance Rt. Impedance tests are conducted at room temperature with a sinusoidal signal of 20 mV applied, and the frequency of the signal is scanned from 1 MHz to 0.01 Hz.

For example, the composite including the conversion coating can exhibit a corrosion resistance $R_t$ of at least 3000 $\Omega\cdot cm^2$, measured at 0.01 Hz according to Corrosion Resistance Test. In a particular embodiment, the composite exhibits a corrosion resistance $R_t$ of at least 3500 $\Omega\cdot cm^2$, or at least 4000 $\Omega\cdot cm^2$, or at least 4500 $\Omega\cdot cm^2$, at least 5000 $\Omega\cdot cm^2$, measured at 0.01 Hz according to Corrosion Resistance Test. In a particular embodiment, the composite exhibits a corrosion resistance $R_t$ of at most 10000 $\Omega\cdot cm^2$, or at most 9000 $\Omega\cdot cm^2$, or at most 8000 $\Omega\cdot cm^2$, at most 7000 $\Omega\cdot cm^2$, measured at 0.01 Hz according to Corrosion Resistance Test. Moreover, the composite can exhibit a corrosion resistance $R_t$ in a range of any of the above minimum and maximum values, such as 3500 to 10000 $\Omega\cdot cm^2$, or 4000 to 9000 $\Omega\cdot cm^2$, or 4500 to 8000 $\Omega\cdot cm^2$, or 5000 to 7000 $\Omega\cdot cm^2$, measured at 0.01 Hz according to Corrosion Resistance Test.

In an embodiment, the conversion coating can improve the corrosion resistance of the interlayer or metal surface. For example, a composite comprising the conversion coating can exhibit a corrosion resistance that is at least 1% greater, at least 5% greater, or at least 10% greater than a corrosion resistance of an identical composite except without the conversion coating.

In an embodiment, the composite can include a treatment layer overlying the conversion coating. The treatment layer can include a resin. For example, the treatment layer can include a paint. The metal surface can exhibit reduced adhesion with respect to the treatment layer and the conversion coating can improve adhesion between the metal surface and the treatment layer.

In an embodiment, the conversion coating can improve adhesion between the interlayer or metal surface and the treatment layer as measured according to the Peel Strength Test. The Peel Strength Test includes 1) providing two steel substrates, 2) applying an adhesive layer of modified ETFE over each steel substrate and applying a tape layer of carbon-filled polytetrafluoroethylene between the layers of modified ETFE, 3) pressing the steel substrates together at a laminating temperature of 315° C. and under a laminating pressure of 0.5 MPa, followed by cooling to about 45° C. and increasing the pressure to 2 MPa, and 4) conducting a standard industry T-Peel Test on an INSTRON Tensile Testing Machine to obtain a peel strength. To conduct the T-Peel Test, after a test laminate is produced as described above, test pieces are cut to have a width of 1 inch (about 2.5 cm) and a length of about 7 inches (about 17.8 cm). The ends of each test piece (both the top and bottom steel substrates) were bent at 90 degree angles so that the resulting test sample is shaped like the letter "T" so that the test sample can be clamped into the upper and lower jaws of the INSTRON Tensile Test Machine. Each test sample was pulled apart at a rate of 2 inches (about 5 cm) per minute and the peel force was measured in Newtons as a function of the displacement of the test sample.

For example, the composite can exhibit a peel strength of at least 140 N, measured according to Peel Strength Test. In a particular embodiment, the composite exhibits a peel strength of at least 142 N, or at least 144 N, or at least 146 N, or at least 148 N, or at least 150 N, measured according to Peel Strength Test. In a particular embodiment, the composite exhibits a peel strength of at most 250 N, or at most 240 N, or at most 230 N, or at least 220 N, or at least 210 N, measured according to Peel Strength Test. Moreover, the composite can exhibit a peel strength in a range of any of the above minimum and maximum values, such as 140 to 250 N, or 142 to 240 N, or 144 to 230 N, or 146 to 220 N, or 148 to 210 N, or 150 to 210 N, measured according to Peel Strength Test.

Many different aspects and embodiments are possible. Some of those aspects and embodiments are described below. After reading this specification, skilled artisans will appreciate that those aspects and embodiments are only illustrative and do not limit the scope of the present invention. Embodiments may be in accordance with any one or more of the embodiments as listed below.

Embodiment 1. A composite comprising:

a substrate; and a conversion coating overlying the substrate and comprising at least one of a zirconium oxide, a hafnium oxide, or a combination thereof;

the composite exhibiting a corrosion resistance $R_t$ of at least 3000 $\Omega\cdot cm^2$, measured at 0.01 Hz according to Corrosion Resistance Test; and the composite exhibiting a peel strength of at least 140 N, measured according to Peel Strength Test.

Embodiment 2. A composite comprising:

a substrate; and a conversion coating overlying the substrate and comprising at least one of a zirconium oxide, a hafnium oxide, or a combination thereof;

the conversion coating formed from a zirconia or hafnia-based complex obtained by reacting a zirconium ion source, a hafnium ion source, or a combination thereof, with a first chelating compound in a first reaction and a second chelating compound in a subsequent second reaction.

Embodiment 3. A method of forming a composite, comprising:

preparing a zirconia or hafnia-based complex by reacting at least one of a zirconium ion source, a hafnium ion source, or a combination thereof, with a first chelating compound in a first reaction and a second chelating compound in a subsequent second reaction; and exposing a substrate to the zirconia or hafnia-based complex to form a conversion coating overlying the substrate and comprising at least one of a zirconium oxide, a hafnium oxide, or a combination thereof.

Embodiment 4. The composite or method of any one of embodiments 2 and 3, wherein at least one of the first and second chelating compound includes at least one of an ethylenediaminetetraacetic acid ("EDTA"), an ethylene diamine, and a N,N,N',N'-tetrakis(2-hydroxypropyl)ethylene diamine, a glycinate, an aspartic acid, an aminopolycarboxylate nicotianamine, an amino acid glycine, a 1,2-bis(o-aminophenoxy)ethane-N,N,N',N'-tetraacetic acid (BAPTA), a 1,4,7,10-tetraazacyclododecane-1,4,7,10-tetraacetic acid (DOTA), an ethylene glycol-bis(β-aminoethyl ether)-N,N,N',N'-tetraacetic acid (EGTA), a nitrilotriacetic acid (NTA), an iminodiacetic acid (IDA), and a diethylenetriaminepentaacetic acid (DTPA).

Embodiment 5. The composite or method of any one of embodiments 2 to 4, wherein the first chelating compound includes an EDTA, or even an EDTA disodium salt dihydrate.

Embodiment 6. The composite or method of any one of embodiments 2 to 5, wherein the second chelating compound includes at least one of an ethylene diamine and a N,N,N',N'-tetrakis(2-hydroxypropyl)ethylene diamine.

Embodiment 7. The composite or method of any one of embodiments 2 to 6, wherein the zirconia or hafnia-based complex is in an aqueous solution.

Embodiment 8. The composite or method of embodiment 7, wherein the aqueous solution is free of an organic solvent.

Embodiment 9. The composite or method of any one of embodiments 2 to 8, wherein the zirconia or hafnia-based complex is in a solution having a pH of at least 1, or at least 2, or at least 3, or at least 3.5, or at least 3.7, or at least 3.9, or at least 4.

Embodiment 10. The composite or method of any one of embodiments 2 to 9, wherein the zirconia or hafnia-based complex is in a solution having a pH of at most 11, or at most 10, or at most 9, or at most 8.5, or at most 8.3, or at most 8.1, or at most 8.0.

Embodiment 11. The composite or method of any one of embodiments 2 to 10, wherein the zirconia or hafnia-based complex is in a solution having a pH in a range of 1 to 11, or 3 to 9, or 4 to 8, or 6 to 7.

Embodiment 12. The composite or method of any one of embodiments 2 to 11, wherein the zirconium ion source includes a salt comprising a zirconium(IV) fluoride hydrate, a zirconium oxynitrate, or combinations thereof.

Embodiment 13. The composite or method of any one of the preceding embodiments, wherein the substrate comprises a metal surface.

Embodiment 14. The composite or method of embodiment 13, wherein the metal surface comprises a steel-based metal, alumina, zinc, or a combination thereof.

Embodiment 15. The composite or method of embodiment 13, wherein the metal surface comprises zinc.

Embodiment 16. The composite or method of any one of embodiment 13 to 15, wherein the metal surface exhibits reduced adhesion with respect to a treatment layer.

Embodiment 17. The composite or method of embodiment 16, wherein the treatment layer comprises a paint.

Embodiment 18. The composite or method of any one of embodiments 13 to 17, wherein the conversion coating improves adhesion between the metal surface and the treatment layer.

Embodiment 19. The composite or method of any one of the preceding embodiments, wherein the substrate includes a metal backing underlying the metal surface.

Embodiment 20. The composite or method of embodiment 19, wherein the metal backing includes an aluminum, an iron, any alloy thereof, or an combination thereof.

Embodiment 21. The composite or method of any one of embodiments 19 and 20, wherein the metal backing includes an iron-based alloy.

Embodiment 22. The composite or method of any one of embodiments 19 to 21, wherein the metal includes a steel or even a galvanized steel.

Embodiment 23. The composite or method of any one of the preceding embodiments, wherein the composite exhibits a corrosion resistance $R_t$ of at least 3500 $\Omega\cdot cm^2$, or at least 4000 $cm^2$, or at least 4500 $\Omega\cdot cm^2$, at least 5000 $\Omega\cdot cm^2$, measured at 0.01 Hz according to the Corrosion Resistance Test.

Embodiment 24. The composite or method of any one of the preceding embodiments, wherein the composite exhibits a corrosion resistance $R_t$ of at most 10000 $\Omega\cdot cm^2$, or at most 9000 $\Omega\cdot cm^2$, or at most 8000 $\Omega\cdot cm^2$, at most 7000 $\Omega\cdot cm^2$, measured at 0.01 Hz according to the Corrosion Resistance Test.

Embodiment 25. The composite or method of any one of the preceding embodiments, wherein the composite exhibits a corrosion resistance $R_t$ in a range of 3500 to 10000 $\Omega\cdot cm^2$, or 4000 to 9000 $\Omega\cdot cm^2$, or 4500 to 8000 $\Omega\cdot cm^2$, or 5000 to 7000 $\Omega\cdot cm^2$, measured at 0.01 Hz according to the Corrosion Resistance Test.

Embodiment 26. The composite or method of any one of the preceding embodiments, wherein the composite exhibits a peel strength of at least 142 N, or at least 144 N, or at least 146 N, or at least 148 N, or at least 150 N, measured according to the Peel Strength Test.

Embodiment 27. The composite or method of any one of the preceding embodiments, wherein the composite exhibits a peel strength of at most 250 N, or at most 240 N, or at most 230 N, or at least 220 N, or at least 210 N, measured according to the Peel Strength Test.

Embodiment 28. The composite or method of any one of the preceding embodiments, wherein the composite exhibits a peel strength in a range of 140 to 250 N, or 142 to 240 N, or 144 to 230 N, or 146 to 220 N, or 148 to 210 N, or 150 to 210 N, measured according to the Peel Strength Test.

Note that not all of the activities described above in the general description or below in the examples are required, that a portion of a specific activity may not be required, and that one or more further activities may be performed in addition to those described. Still further, the order in which activities are listed is not necessarily the order in which they are performed.

EXAMPLES

Example 1—Peel Strength

Figure 7:
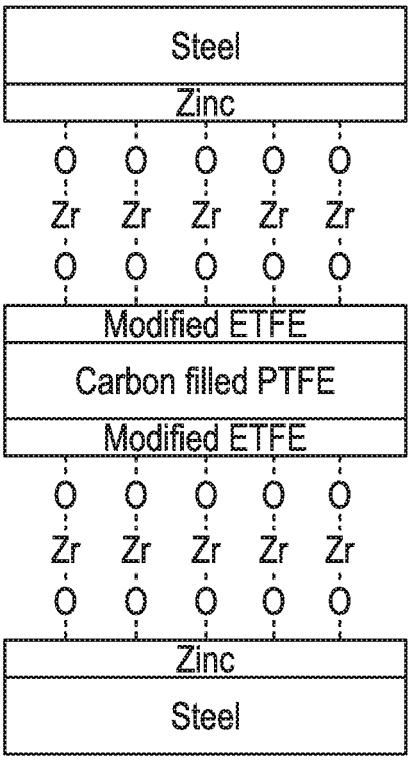
FIG. 7 includes an illustration of a sample for Example 1 described herein.
Figure 8:
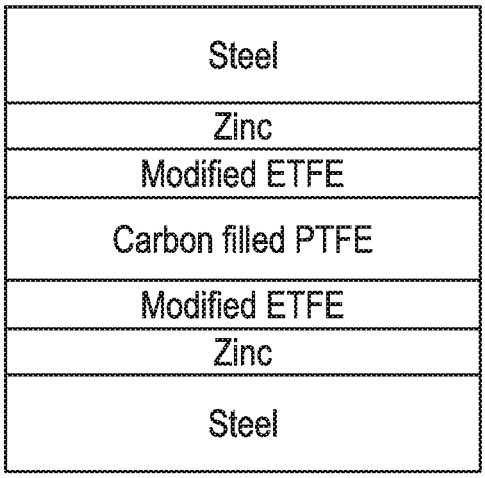
FIG. 8 includes an illustration of comparative sample for Example 1 described herein.

Three samples (Samples 1, 2, and 3) of zirconia-conversion coated galvanized steel according to embodiments described herein were tested to evaluate peel strength and compare with three samples (Samples 4, 5, and 6) of non-modified galvanized steel. Samples 1 to 6 were formed by applying an adhesive layer of modified ETFE over each steel substrate and applying a tape layer of carbon-filled polytetrafluoroethylene between the layers of modified ETFE. The substrates were then pressed together at a laminating temperature of 315° C. and under a laminating pressure of 0.5 MPa, followed by cooling to about 45° C. and increasing the pressure to 2 MPa. The final composition of Samples 1, 2, and 3 is illustrated in FIG. 7 and the composition of Samples 4, 5, and 6 is illustrated in FIG. 8.

Each of the samples was subjected to the Peel Strength Test described above. In particular, the test pieces were cut to have a width of 1 inch (about 2.5 cm) and a length of about 7 inches (about 17.8 cm). The ends of each test piece (both the top and bottom steel substrates) were bent at 90 degree angles so that the resulting test sample is shaped like the letter "T" so that the test sample can be clamped into the upper and lower jaws of the INSTRON Tensile Test Machine. Each test sample was pulled apart at a rate of 2 inches (about 5 cm) per minute and the peel force was measured in Newtons as a function of the displacement of the test sample.

During the Peel Strength Test, Samples 1, 2, and 3 displayed mainly cohesive failure during the peel test whereas Samples 4, 5, and 6 did not. Further, the average peel strength of Samples 1, 2, and 3 was in the range of 150-220 N, whereas the average peel strength of Samples 4, 5, and 6 was in the range of 100-170 N.

Example 2—Corrosion Resistance

Figure 9:
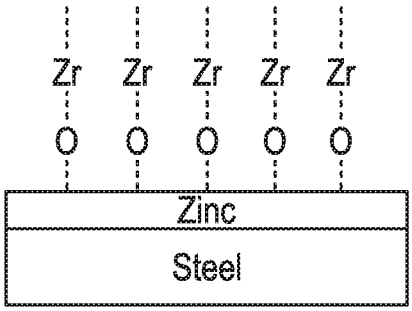
FIG. 9 includes an illustration of a sample for Example 2 described herein.
Figure 10:
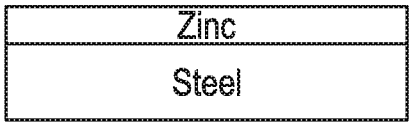
FIG. 10 includes an illustration of comparative sample for Example 2 described herein.

Two samples (Samples 7 and 8) of zirconia-conversion coated galvanized steel according to embodiments described herein were tested to evaluate corrosion resistance and to compare with the corrosion resistance of two samples (Samples 9 and 10) of non-modified galvanized steel. The composition of Samples 7 and 8 is illustrated in FIG. 9 and the composition of Samples 9 and 10 is illustrated in FIG. 10.

Samples 7 and 9 were immersed in a 5 wt % sodium chloride in DI water solution at room temperature for 28 hours. Sample 9 demonstrated heavy white corrosion in comparison with Sample 7.

Samples 8 and 10 were then immersed in a 16 wt % sodium chloride in DI water solution at 90° C. for 4 hours. Sample 10 showed heavy red corrosion in comparison with Sample 8.

Zirconium oxide based conversion coatings according to embodiments described herein displayed improvement in peel strength in comparison with standard control samples. As well, zirconium oxide based conversion coatings according to embodiments described herein demonstrated improvement in corrosion resistance.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the embodiments.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

The invention claimed is:

1. A composite comprising:

a substrate comprising a metal backing underlying a metal surface comprising zinc; and a conversion coating overlying the substrate and comprising at least one of a zirconium oxide, a hafnium oxide, or a combination thereof;

the conversion coating formed from a zirconia or hafnia-based complex obtained by reacting a zirconium ion source, a hafnium ion source, or a combination thereof, with a first chelating compound in a first reaction and a second chelating compound in a subsequent second reaction, wherein at least one of the first and second chelating compound includes at least one of an ethylene diamine, N,N,N',N'-tetrakis(2-hydroxypropyl)ethylene diamine, a glycinate, an aspartic acid, an aminopolycarboxylate nicotianamine, an amino acid glycine, a 1,2-bis(o-aminophenoxy)ethane-N,N,N',N'-tetraacetic acid (BAPTA), a 1,4,7,10-tetraazacyclododecane-1,4,7,10-tetraacetic acid (DOTA), an ethylene glycol-bis(β-aminoethyl ether)-N,N,N',N'-tetraacetic acid (EGTA), a nitrilotriacetic acid (NTA), an iminodiacetic acid (IDA), or a diethylenetriaminepentaacetic acid (DTPA).

2. The composite of claim 1, wherein the second chelating compound includes at least one of an ethylene diamine or a N,N,N',N'-tetrakis(2-hydroxypropyl)ethylene diamine.

3. The composite of claim 1, wherein the zirconia or hafnia-based complex is in a solution having a pH of at least 1.

4. The composite of claim 1, wherein the zirconia or hafnia-based complex is in a solution having a pH of at most 11.

5. The composite of claim 1, wherein the zirconia or hafnia-based complex is in a solution having a pH in a range of 1 to 11.

6. The composite of claim 1, wherein the zirconium ion source includes a salt comprising a zirconium(IV) fluoride hydrate, a zirconium oxynitrate, or combinations thereof.

7. The composite of claim 1, wherein the metal surface comprises a steel-based metal, alumina, zinc, or a combination thereof.

8. The composite of claim 1, wherein the metal backing includes an aluminum, an iron, any alloy thereof, or an combination thereof.

9. The composite of claim 8, wherein the metal backing includes an iron-based alloy.

10. The composite of claim 1, wherein the composite exhibits a corrosion resistance $R_t$ in a range of 3500 to 10000 $\Omega \cdot cm^2$, measured at 0.01 Hz.

11. The composite of claim 1, wherein the composite exhibits a peel strength in a range of 140 to 250 N.

12. A composite comprising:

a substrate comprising a metal backing underlying a metal surface comprising zinc; and a conversion coating overlying the substrate and comprising at least one of a zirconium oxide, a hafnium oxide, or a combination thereof;

the composite exhibiting a corrosion resistance $R_t$ of at least 3000 $\Omega \cdot cm^2$, measured at 0.01 Hz; and the composite exhibiting a peel strength of at least 140 N, the conversion coating formed from a zirconia or hafnia-based complex obtained by reacting a zirconium ion source, a hafnium ion source, or a combination there, with a first chelating compound in a first react and a second chelating compound in a subsequent second reaction wherein at least one of the first and second chelating compounds includes at least one of an ethylene diamine, N,N,N',N'-tetrakis(2-hydroxypropyl) ethylene diamine, a glycinate, an aspartic acid, an aminopolycarboxylate nicotianamine, an amino acid glycine, a 1,2-bis(o-aminophenoxy)ethane-N,N,N',N'-tetraacetic acid (BAPTA), a 1,4,7,10-tetraazacyclodecane-1,4,7,10-tetraacetic acid (DOTA), an ethylene glycol-bis(β-aminoethyl ether)-N,N,N',N'-tetraacetic acid (EGTA), a nitrilotriacetic acid (NTA), an iminodiacetic acid (IDA), or a diethylenetriaminepentaacetic acid (DTPA).

13. The composite of claim 1, wherein at least one of the first and second chelating compound includes N,N,N',N'-tetrakis(2-hydroxypropyl)ethylene diamine.

14. The composite of claim 1, wherein at least one of the first and second chelating compound includes a glycinate.

15. The composite of claim 1, wherein at least one of the first and second chelating compound includes an aspartic acid.

16. The composite of claim 1, wherein at least one of the first and second chelating compound includes an aminopolycarboxylate nicotianamine.

17. The composite of claim 1, wherein at least one of the first and second chelating compound includes an amino acid glycine.

18. The composite of claim 1, wherein at least one of the first and second chelating compound includes a 1,2-bis(o-aminophenoxy)ethane-N,N,N',N'-tetraacetic acid (BAPTA).

19. The composite of claim 1, wherein at least one of the first and second chelating compound includes a 1,4,7,10-tetraazacyclododecane-1,4,7,10-tetraacetic acid (DOTA).

20. The composite of claim 1, wherein at least one of the first and second chelating compound includes an ethylene glycol-bis(β-aminoethyl ether)-N,N,N',N'-tetraacetic acid (EGTA).

* * * * *